US006544149B2

(12) United States Patent
O'Shea

(10) Patent No.: US 6,544,149 B2
(45) **Date of Patent: *Apr. 8, 2003**

(54) SKIPPING ROPES

(76) Inventor: Clayton O'Shea, 72 Westacott Close, London N19 (GB)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/774,376

(22) Filed: Jan. 31, 2001

(65) Prior Publication Data

US 2001/0011054 A1 Aug. 2, 2001

(30) Foreign Application Priority Data

Feb. 1, 2000 (GB) ..... 0002337

(51) Int. Cl.[7] ..... A63B 21/00
(52) U.S. Cl. ..... 482/82; 482/81
(58) Field of Search ..... 482/81, 82, 126, 482/904, 907, 121

(56) References Cited

U.S. PATENT DOCUMENTS 1,436,703 A * 11/1922 Fisher ..... 482/82
3,415,515 A 12/1968 Otto
5,215,509 A 6/1993 Meyer
5,372,558 A * 12/1994 Perry et al. ..... 482/121

FOREIGN PATENT DOCUMENTS

| | | | | |
|---|---|---|---|---|
| FR | 2 366 848 A | | 5/1978 | |
| GB | 161 388 A | | 4/1921 | |
| GB | 875 750 A | | 8/1961 | |
| GB | 2166058 A | * | 3/1984 | ..... 482/82 |
| GB | 2189160 A | | 10/1987 | |
| WO | WO9938574 A | | 8/1999 | |

OTHER PUBLICATIONS

WPI English abstract for FR236648 (one page).

* cited by examiner

*Primary Examiner*—Jerome W. Donnelly
(74) *Attorney, Agent, or Firm*—Alexandre Montagu, PC; Joseph F. Murphy

(57) ABSTRACT

Conventional skipping ropes have a generally elongate handle swivellably mounted on each end of the rope which is held by the user between the fingers and palms. In accordance with the invention, the handle is shaped like a "T" with the vertical stroke of the T (3) swivellably connected to the rope (1). The handle may be held with the crosspiece of the T (4) between fingers and palm and with the vertical extending between two fingers. This gives a more comfortable and effective skipping position.

4 Claims, 1 Drawing Sheet

SKIPPING ROPES

Figure 1:
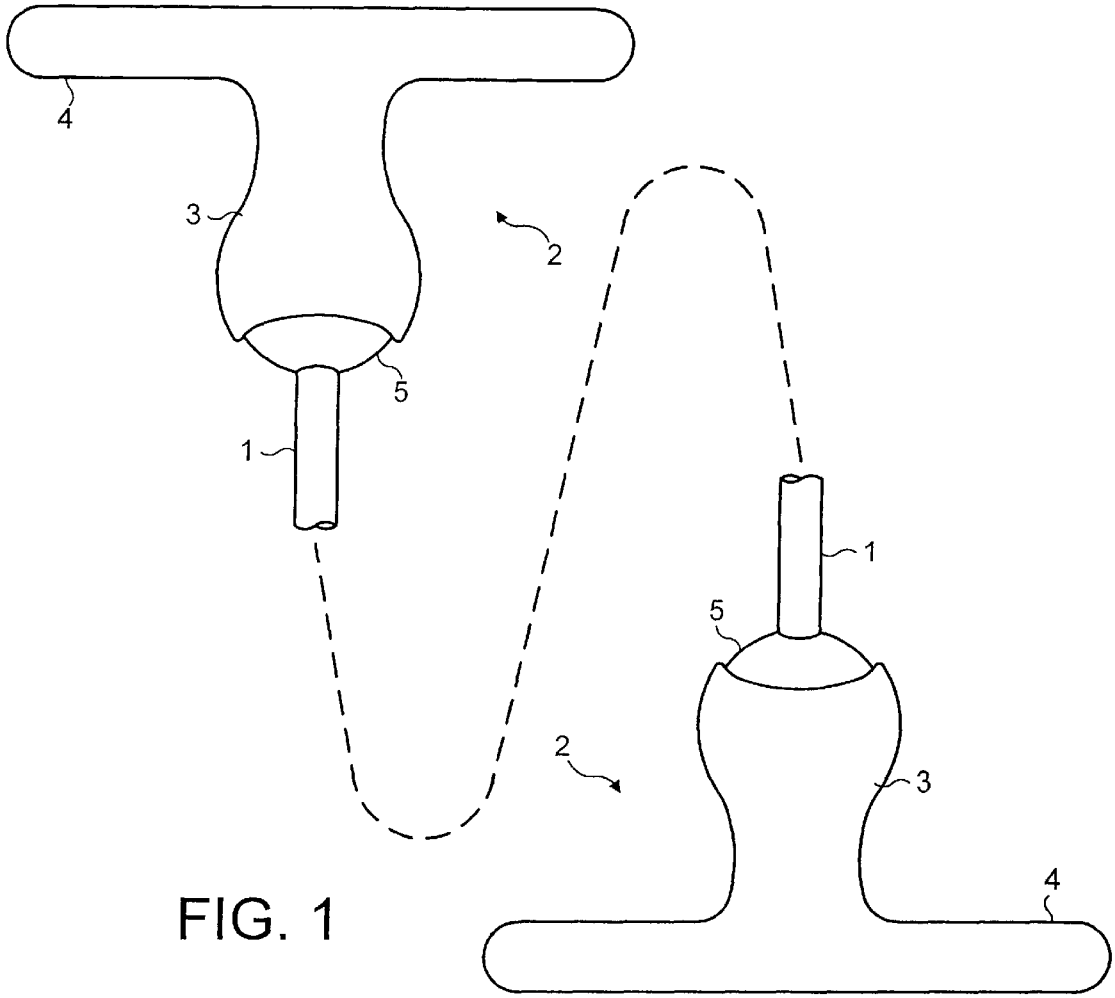

This invention relates to skipping ropes.

Skipping ropes have been known for centuries and constitute both a children's activity plaything and a serious device for promoting health and fitness. The exercise of skipping is one which can have substantial beneficial effects. It is particularly practiced by boxers in order to build up muscle strength and tone as well as sharpening reactions.

Conventional skipping ropes consist of a length of flexible material such as rope or a plastics substitute for rope with a handle at each end.

Generally speaking, the handle is an elongate member which, if held up by the rope, extends vertically. While not absolutely necessary, most skipping ropes enable the rope to swivel about the elongate axis of the handle in order that, as the loop of rope is turned around the body of the person skipping during that activity, it does not undergo twisting.

The conventional disposition of handles and swivel mechanisms is not ideal, particularly for serious skipping, for a number of reasons:

First the holding position of the handles is somewhat awkward; with the handles held extending across the palm of the hand, and held against that by the curled fingers and the thumb, in order to position the handle horizontally and with the end from which the rope extends remote from the skipper's body, the arms must be turned outwards around their longitudinal axis. This is not particularly comfortable, compared with the relaxed position of the hands when the arms are simply allowed to hang at a person's sides, where the palms face inwards.

Secondly, the swivel mechanism introduces friction and drag which, at high skipping speeds, can be substantial.

Also, at high skipping speeds it is easy for the handle to slip axially within the hand, or even, due to the high pull from the rotating rope, slip out from the hand entirely. If slippage is compensated by the skipper attempting to shift the handle inwards, this can easily lead to the handle being moved so far in that the rotating rope then starts to chafe at the knuckles of the thumb and first finger, which is naturally undesirable.

According to the present invention, a skipping rope is characterised by having a handle at each end which consists of an elongate portion attached to one end of the rope and a portion transverse thereto at its outer end. This provides a type of "T-bar" handle, with much improved grip.

When using such a skipping rope, the transverse portion can be held easily effectively in the palm of the hand with the elongate portion extending between two fingers. This gives a much more comfortable skipping position as well as a considerably more slip-proof one, even if the hand becomes sweaty. The transverse portion of the handle nestles within the curled up fingers while the elongate portion extends between two of the fingers, usually most comfortably the first and second fingers. The effective grip on the handle is much stronger, and the distribution of forces is better configured with the base of the fingers taking the strain rather than the forefinger and thumb doing so. This can be of particular importance if the skipper does not have a strong grip, for example due to arthritis, injury or even deformity in the hand or hands. The position is much more secure, being more in the nature of a mechanical interlock than a friction grip. The hands are also held at the sides without twisting the arms, i.e. with the backs of the hands facing outwards on opposite sides of the skipper's body.

The rope is preferably attached to the handle by means of a swivel. This is preferably a low friction swivel, for example a small ball-bearing or the like, but many types of simple mechanical joint construction may be used. One possibility is to have the end of the rope pass through a bore in a ball, the end being knotted and the knot located in a counterbore to prevent it protruding form the outline of the ball. The ball may then be received in a cup of or internally coated with low-friction material mounted on the end of the elongate part of the handle remote from the transverse part. The ball may be held captive in the cup by suitable means, and may also be constrained to rotate within the cup in such a fashion that the axis of the rope lies within a certain solid angular range relative to the axis of the elongate portion of the handle. In an alternative construction, the end of the rope may be arranged to extend substantially transversely to the axis of the elongate portion of the handle. For example, the rope may be fixed at each end to a swivel collar which, via a suitable low friction bearing, is mounted on the end of the handle remote from the transverse portion.

The handles may be made of any convenient material or assembly of materials. The handle may be a unitary plastics moulding.

Figure 2:
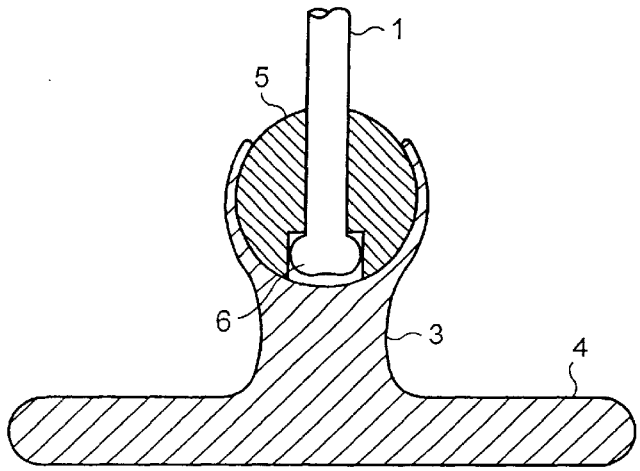

A skipping rope in accordance with the invention is illustrated by way of example in the accompanying diagrammatic drawings. In the drawings:

FIG. 1 is a side view of a skipping rope in accordance with the invention with the majority of the rope omitted for clarity, and FIG. 2 is a longitudinal section through one end of the skipping rope.

Referring to the drawings, a rope 1 has on each end a handle 2. Each handle consists of an elongate portion 3 which is adapted to be placed between the fingers with a transverse portion 4 then resting inside the hand of the skipper. The ends of the rope are attached to a rotatable collar 5 which is set in a cup at the end of portion 3. The materials of the ball and the cup are chosen to enable the ball to rotate with low friction. The end of rope 1 passes through a relatively close-fifting bore in ball 5 and is held captive in the ball by a knot or other enlarged end portion which is located in an enlarged counterbore 6 in ball 5. The dimensions of ball 5 and the cup on the end of portion 3 are such that the ball may be press-fitted into place using a force sufficient to enable that to occur, but without damage to the cup, the force to pull the rope 1 and ball 5 out of the cup being sufficiently high to ensure that the ball remains captive even at high skipping speeds. length of portion 3 is sufficient to hold the rope sufficiently far away from the back of the user's hand to avoid risk of the rope rubbing or chafing the user's hand.

It is found that using skipping ropes in accordance with the present invention, a substantially more comfortable position of the skipper's hands is achieved and the skipping action is enhanced by the very low frictional losses as the rope is rotated around the body of the skipper. This enables more vigorous and more enjoyable skipping to be practiced, as well as enhancing the ability of the skipper to learn to perform various skipping tricks effectively.

What is claimed is:

1. A skipping rope consisting of a length of flexible material with a handle swivellably mounted at each end thereof, wherein each handle is substantially shaped, and consists of an elongate portion attached to one end of the rope and a portion transverse thereto at its outer end, wherein the elongate portion extends between two digits.

2. A skipping rope according to claim 1 wherein the rope is attached to the elongate portion of each handle via a swivelling ball through which the end of the rope passes.

3. A skipping rope according to claim 2 wherein the elongate portion of each handle comprises a cup for receiving the ball and means to retain the ball within the cup.

4. A skipping rope according to any of claims 1 to 3 wherein the handle is a unitary plastics moulding.

* * * * *

UNITED STATES PATENT AND TRADEMARK OFFICE

CERTIFICATE OF CORRECTION

PATENT NO. : 6,544,149 B2
DATED : April 8, 2003
INVENTOR(S) : O'Shea, Clayton

It is certified that error appears in the above-identified patent and that said Letters Patent is hereby corrected as shown below:

Column 5,
Line 6, "shaped" should be -- T-shaped --.

Signed and Sealed this

Twenty-third Day of September, 2003

JAMES E. ROGAN
*Director of the United States Patent and Trademark Office*